350-276 SR
12/7/76 XR 3,996,458

United States Patent [19]
Jones et al.
[11] 3,996,458
[45] Dec. 7, 1976

[54] CEILING SYSTEM

[76] Inventors: Terry D. Jones, 4420 Park Alisal, Calabas Park, Calif. 91302; John E. Stanley, 5421 Burning Tree Drive, La Canada, Calif. 91011

[22] Filed: Sept. 8, 1975

[21] Appl. No.: 611,502

Related U.S. Application Data

[63] Continuation of Ser. No. 445,592, Feb. 25, 1974, abandoned.

[52] U.S. Cl. ..... 240/9 R; 240/106 R; 52/28; 52/306; 350/276 R

[51] Int. Cl.[2] ..... E04B 5/62

[58] Field of Search ..... 52/28, 306, 307, 116; 240/92.9, 93, 106 R, 1 EL; 350/285, 276 R, 276 SL, 96 T, 96 A

[56] References Cited

UNITED STATES PATENTS

| | | | |
|---|---|---|---|
| 142,473 | 9/1873 | Hyatt | 52/306 |
| 2,218,992 | 10/1940 | Munroe | 52/307 |
| 2,695,430 | 11/1954 | Wakefield | 52/307 |
| 2,975,853 | 3/1957 | Friend | 52/306 |
| 3,054,223 | 9/1962 | O'Brien | 52/306 |
| 3,368,070 | 2/1968 | Schwartz | 240/9 |
| 3,668,381 | 6/1972 | Schwartz | 240/106 R |
| 3,721,818 | 3/1973 | Stahlhut | 240/106 R |
| 3,760,179 | 9/1973 | Addington | 52/307 |

FOREIGN PATENTS OR APPLICATIONS

| | | | |
|---|---|---|---|
| 1,184,817 | 7/1959 | France | 52/307 |
| 1,056,031 | 4/1959 | Germany | 52/144 |
| 14,008 | 5/1970 | Japan | 350/276 |
| 872,410 | 7/1961 | United Kingdom | 52/308 |
| 914,868 | 1/1963 | United Kingdom | 52/308 |

*Primary Examiner*—Price C. Faw, Jr.
*Assistant Examiner*—Henry Raduazo
*Attorney, Agent, or Firm*—Wills, Green & Mueth

[57] ABSTRACT

A novel decorative ceiling comprising:

1. a grid of T-bar runners and cross members, 2. a flat horizontal rigid plastic sheet, preferably having a pattern of areas transmissive to light and areas opaque to light, the edges of which rest on said T-bars, 3. a source of illumination in the plenum above said grid, 4. adhesively joined to said sheet and extending downwardly from transmissive areas, a plurality of plastic cells having planar sides, said cells being open at their bottom ends, the planar sides of adjoining cells being spaced apart by a distance at least equal to the width of the horizontal portion of said T-bars.

Also, the subcombination, adapted to be supported at its edges by T-bars, comprising:

1. a flat horizontal rigid plastic sheet having a pattern of areas transmissive to light and areas opaque to light the edges of which rest on said T-bars, 2. adhesively joined to said sheet and extending downwardly from transmissive areas, a plurality of plastic cells having planar sides, said cells being open at their bottom ends, the planar sides of adjoining cells being spaced apart by a distance at least equal to the width of the horizontal portion of said T-bars.

10 Claims, 7 Drawing Figures

FIG. 1.
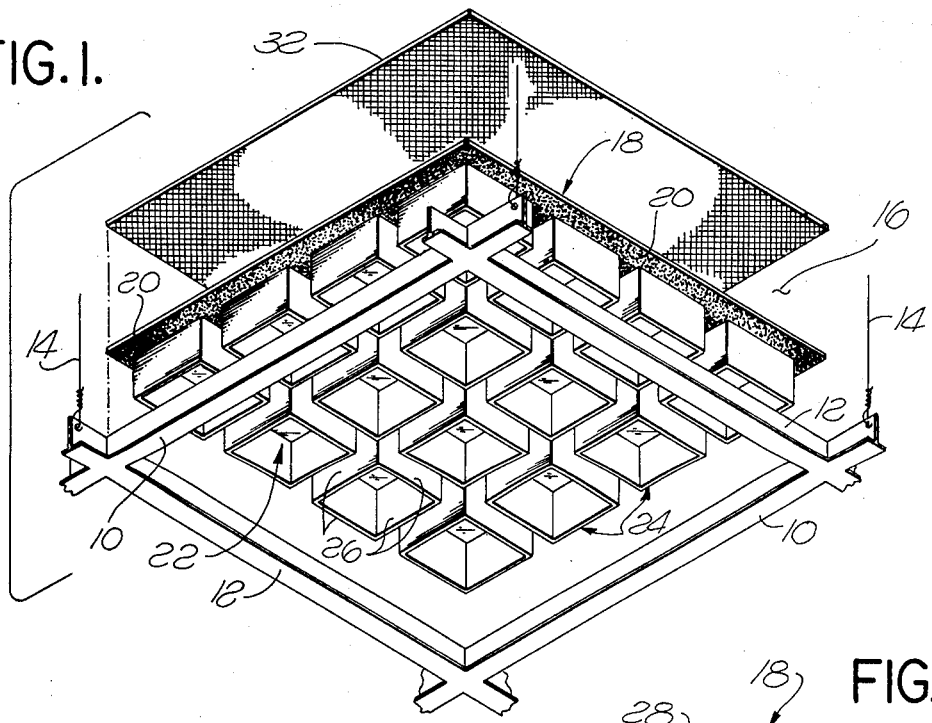
FIG. 2.
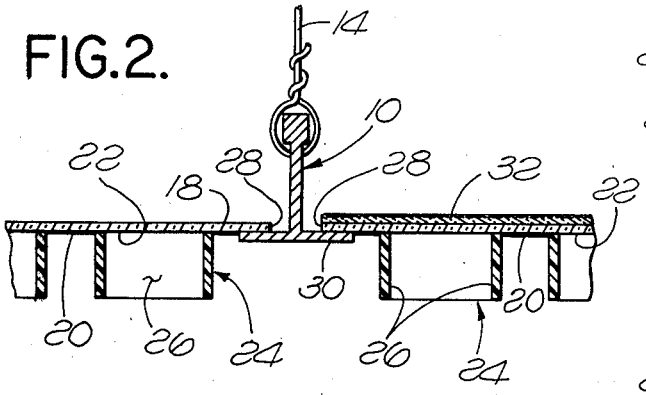
FIG. 5.
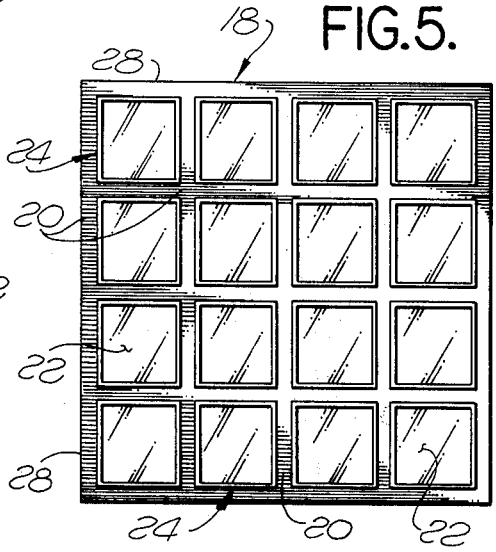
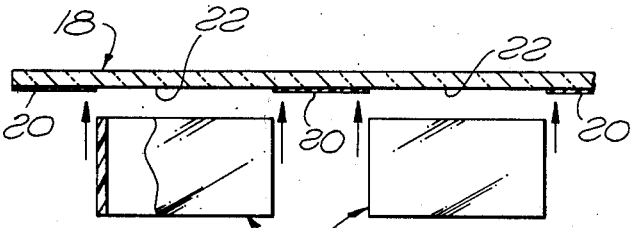
FIG. 3.
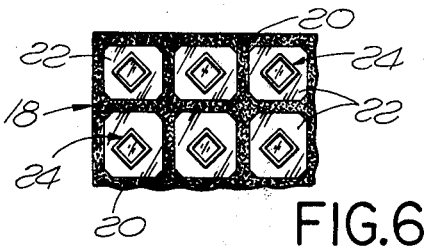
FIG. 6.
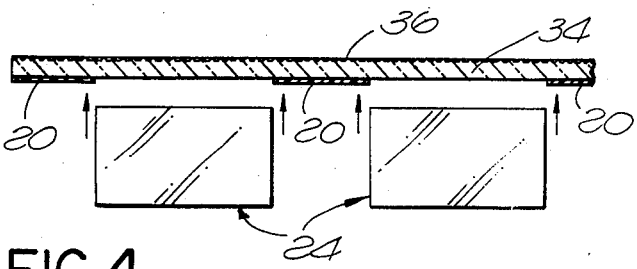
FIG. 4.
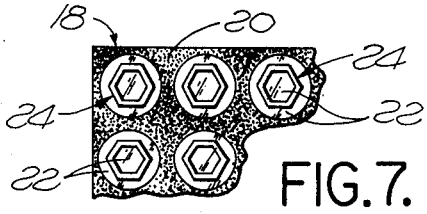
FIG. 7.

CEILING SYSTEM

This is a continuation of application Ser. No. 445,592, filed Feb. 25, 1974 and now abandoned.

BACKGROUND OF THE INVENTION

The field of this invention relates to a novel illuminated ceiling structure and components thereof which are more adaptable to varying requirements of structure and appearance.

A luminous ceiling system made up of a plurality of preformed integral panels laid into an inverted T-bar grid has been known. Each of the preformed panels are molded from acrylic sheet or other plastic powders so that the downwardly extending cells are integral with the horizontal portion of the panel. The problems with this structure are several. First, the integral molded part usually does not exactly fit the installation site around posts or corners. This requires trimming of the panel. However, cutting off or trimming a panel on the job site is difficult since the equipment required to perform this operation neatly is not to be found at the job site. Further, trimming of a panel involves cutting through cells which creates an uneven and unsightly effect in ceiling areas adjoining posts and corners.

Another problem with the integral-type panels is that they are relatively limited in the number of different effects which can be created. Every integral design requires its own stamping or molding die. The dies each represent a significant investment. The integral panels also pose problems of inventory management since alteration of the panels to meet demand is not possible once they leave the point of manufacture.

The present invention overcomes the problems outlined hereinafter and it is believed that the invention of this patent will be rapidly adopted by those skilled in the art.

SUMMARY OF THE INVENTION

Briefly, the present invention comprises the subcombination, adapted to be supported at its edges by T-bars, comprising:

1. a flat horizontal rigid plastic sheet which rests on said T-bars, 2. adhesively joined to said sheet and extending downwardly therefrom, a plurality of plastic cells having planar sides, said cells being open at their bottom ends, the planar sides of adjoining cells being spaced apart by a distance at least equal to the width of the horizontal portion of said T-bars.

The preferred embodiment of the present invention comprises the subcombination, adapted to be supported at its edges by T-bars comprising:

1. a flat horizontal rigid plastic sheet having a pattern of areas transmissive to light and areas opaque to light the edges of which rest on said T-bars, 2. adhesively joined to said sheet and extending downwardly from transmissive areas, a plurality of plastic cells having planar sides, said cells being open at their bottom ends, the planar sides of adjoining cells being spaced apart by a distance at least equal to the width of the horizontal portion of said T-bars.

Our invention also comprehends a novel decorative ceiling comprising:

1. a grid of T-bar runners and cross members, 2. a flat horizontal rigid plastic sheet having a pattern of areas transmissive to light and areas opaque to light the edges of which rests on said T-bars, 3. a source of illumination in the plenum above said grid, 4. adhesively joined to said sheet and extending downwardly from transmissive areas, a plurality of plastic cells having planar sides, said cells being open at their bottom ends, the planar sides of adjoining cells being spaced apart by a distance at least equal to the width of the horizontal portion of said T-bars.

It is an object of our invention to provide a novel ceiling structure.

More particularly, it is an object of this invention to provide a new and novel structure of greater flexibility and adaptability to the requirements encountered in building construction.

It is a further object of this invention to provide a new arrangement which avoids unsightly ceiling areas.

A further object of our invention is the provision of a structure which can be readily made to conform to a wide variety of architectural requirements.

These and other objects and advantages of our invention will be apparent from the detailed description which follows when taken in conjunction with the accompanying drawings.

DESCRIPTION OF THE PREFERRED EMBODIMENTS

In the drawings:

FIG. 1 is a perspective view looking upwardly at the ceiling and showing the novel structure of one embodiment of this invention partially exploded.

FIG. 2 is a side sectional view of the ceiling structure of FIG. 1.

FIG. 3 is a side sectional view of part of the structure of FIGS. 1 and 2 showing the horizontal sheet and cells prior to adhesive joining.

FIG. 4 is a side sectional view of another embodiment of our invention.

FIG. 5 is a bottom plan view of the structure of FIGS. 1 and 2.

FIG. 6 is a bottom plan view of yet another embodiment of this invention.

FIG. 7 is a bottom plan view of still another embodiment of this invention.

Turning to the drawings in greater detail, the grid structure having T-bar runners 10 and T-bar cross members 12 is supported by hangers 14 in conventional manner, providing an open space of plenum 16 thereabove in which lighting fixtures of any described type may be provided. The flat horizontal plastic sheet 18, normally acrylic, preferably has opaque or light non-transmiting areas 20 and light transmitting areas 22. The cells 24 in this embodiment are cube shaped and have four planar sides 26. The edges 28 of the sheet 18 are carried by the horizontal portion 30 of the T-bars 10 and 12.

Since the normal fabrication leaves clear "windows" in the horizontal panel 18, another continuous flat shielding panel 32 can be laid on top of the horizontal panel 18. This shielding panel 32 is usually translucent white or has a prismatic pattern which hides a direct view of the lighting source above which is usually fluorescent tube fixtures. As shown in FIG. 4, the horizontal sheet or panel 34 may itself have a translucent or prismatic upper surface 36, combining the two separate sheets of the embodiment of FIG. 1 – 3 and 5.

The cells 24 are individually injection molded of acrylic plastic but may be molded of any type of plastic to achieve certain finishes. Cells are open top and bottom. Cells are cemented to the bottom of the horizontal panel 18 at regular center-to-center spaces so as to achieve an unbroken appearance when placed in supportive frame alongside other like panels.

Clear transparent plastic (acrylic) sheets 18 are used for the horizontal panels. These sheets are generally 23 ¾ inch squares as determined by standard supportive grid systems of steel or aluminum, but may be 11 ¾ inch x 23 ¾ inch or any mulitple of 1 foot minus ¼ inch. Panels may be of varying thicknesses as required for structural strength, but generally is either 3/16 inch or ¼ inch in thickness.

In order to provide shielding of the supportive grid, an opaque pattern is preferably applied between the cell positions at regular intervals so as to coincide with the supportive grid spacing. The grid system is painted the same color as the color of the opaque shielding on the horizontal panel. When this is done, the grid system blends into the over-all pattern is practically invisible. The opaque shielding on the horizontal panel is applied by silk screening the pattern onto the panel in the desired color using a paint which bonds to the plastic panel, or by hot stamping another thin opaque colored plastic to the horizontal panel. In some cases, the opaque shielding is not needed since by appropriate coloring of the grid and the shadows created by the cells an attractive appearance results.

The various embodiments of this invention are almost limitless and the "cells" may be placed at any position on the surface of the horizontal sheet. One such embodiment is shown in FIG. 6 where the cells are smaller than the light transmissive area and rotated so that the sides of the cells are at an angle with respect to the sides of the transmissive areas. It is also possible to vary the cell configuration into such as a hexigon (as shown in FIG. 7), actagon or other shape and since these shapes would be individually molded, they too could be moved into any position on the horizontal panel within the silk screened or painted pattern. The individual cells can be clear or uniformly colored. They can also be a mixture of clear and colored or a mixture is arranged in a predetermined pattern or design, One preferred embodiment is transparent bronze cells with the opaque areas of the horizontal plastic sheet being black.

It should be noted that the cells need not necessarily be applied to horizontal translucent plastic panels which have silk screened opaque areas as described before. The cells when applied to translucent panels in a regular pattern as described before to a translucent panel without the silk screened areas are quite pleasing and let more light through. The advantages of spacing are the same as well as column accommodation and angular wall condition accommodation still remain. The supportive grid is obvious but the light output is more efficient.

Having fully described the invention it is intended that it be limited only by the scope of the appended claims.

We claim:

1. The subcombination, adapted to be supported at its edges by T-bars comprising:

1. a flat horizontal rigid plastic sheet having a smooth surface and a generally uniform pattern of areas transmissive to light and areas opaque to light, the edges of which are adapted to rest on said T-bars,
2. a plurality of uniformly spaced-apart plastic cells having planar walls, said cells being open at their top and bottom ends and free of obstructions, said cells being adhesively joined to the smooth surface of said sheet and the walls thereof projecting perpendicularly downwardly therefrom, said adhesive joinder being by abutment of the top end of said cells to said sheet to form an adhesive line, said adhesive line being limited in area to the cross section of the cell walls, the bottom end of said cell being open and the smooth surface of said sheet being visible through said bottom end, at least those areas of said sheet within the perimeter defined by each said cell being transmissive to visible light so that light can shine downwardly through said cells, and said opaque areas of said sheet extending between adjacent cells and including at least those areas of said sheet adapted to be supported by T-bars.

2. A novel decorative ceiling comprising:

1. a grid system of T-bar runners and cross members,
2. a plurality of flat horizontal rigid plastic sheets, each having a smooth surface and a generally uniform pattern of areas transmissive to light and areas opaque to light, the edges of which rest on said T-bars,
3. a source of illumination in the plenum above said grid,
4. from transmissive areas, a plurality of uniformly spaced-apart plastic cells having planar walls, said cells being open at their top and bottom ends and free of obstructions, said cells being adhesively joined to the smooth surface of said sheet and the walls thereof projecting perpendicularly downwardly therefrom, said adhesive joinder being by abutment of the top end of said cells to said sheet to form an adhesive line, said adhesive line being limited in area to the cross section of the cell walls, the bottom end of said cells being open and the smooth surface of said sheet being visible through said bottom end, at least those areas of said sheets within the perimeter defined by each said cell being transmissive to visible light so that light from said plenum can shine through said cells, and said opaque areas of said sheet extending between adjacent cells and including at least those areas of said sheets supported by T-bars and cross members to thereby conceal said grid system when said ceiling is viewed from below.

3. The structure of claim 2 wherein said opaque areas are in the form of a material applied to the same side of the said sheets as the cells.

4. The structure of claim 2 wherein the opaque areas are in the form of a material applied to the side of said sheets opposite the side to which said cells are joined.

5. The structure of claim 2 wherein there is provided a second sheet in superposed position above said plastic sheets, said second sheet being light diffusing.

6. The structure of claim 2 wherein the upper surface of said plastic sheets are light diffusing.

7. The structure of claim 4 wherein the upper surface of said plastic sheets are prismatic.

8. The structure of claim 2 wherein the perimeter of the cells are coextensive with the light transmissive areas and conform to the perimeter of said areas, and the sheets are otherwise completely opaque to visible light.

9. The structure of claim 2 wherein the perimeter of the cells are smaller than said light transmissive areas.

10. The structure of claim 2 wherein the planar walls of adjoining cells of adjacent plastic sheets are spaced apart by a distance at least equal to the width of the horizontal portion of said T-bars.

* * * * *